United States Patent [19]

Lebet et al.

[11] 4,180,808

[45] Dec. 25, 1979

[54] ALARM CIRCUIT

[75] Inventors: Jean-Philippe Lebet, Les Geneveys-sur-Coffrane; Jean-Claude Droz, Neuchatel, both of Switzerland

[73] Assignee: The Gillette Company, Boston, Mass.

[21] Appl. No.: 859,343

[22] Filed: Dec. 12, 1977

[51] Int. Cl.[2] ..... G08B 3/00

[52] U.S. Cl. ..... 340/384 E; 58/38 R; 340/384 R

[58] Field of Search ..... 340/384 E, 384 R; 58/38 R, 57.5

[56] References Cited

U.S. PATENT DOCUMENTS

| | | | |
|---|---|---|---|
| 3,912,952 | 10/1975 | Kumon | 340/384 E |
| 4,064,507 | 12/1977 | Schmitz | 340/384 E |
| 4,090,349 | 5/1978 | Takase | 340/384 E |

*Primary Examiner*—Harold I. Pitts
*Attorney, Agent, or Firm*—Richard A. Wise; Raymond J. De Vellis

[57] ABSTRACT

A circuit for providing an audible alarm, capable of having a characteristic sound. The acoustic/alert circuit includes a battery and a self-starting voltage multiplier including a capacitor which provides a higher source of voltage to power an associated binary counter and transducer element as well as providing a source of input frequency to the binary counter. The input frequency signal drives the binary counter with its plurality of fractional frequency outputs. At least two of these fractional frequency outputs are used in combination with logic circuitry to generate a modulated complex signal to a gated oscillator means which includes a sound generating transducer.

5 Claims, 1 Drawing Figure

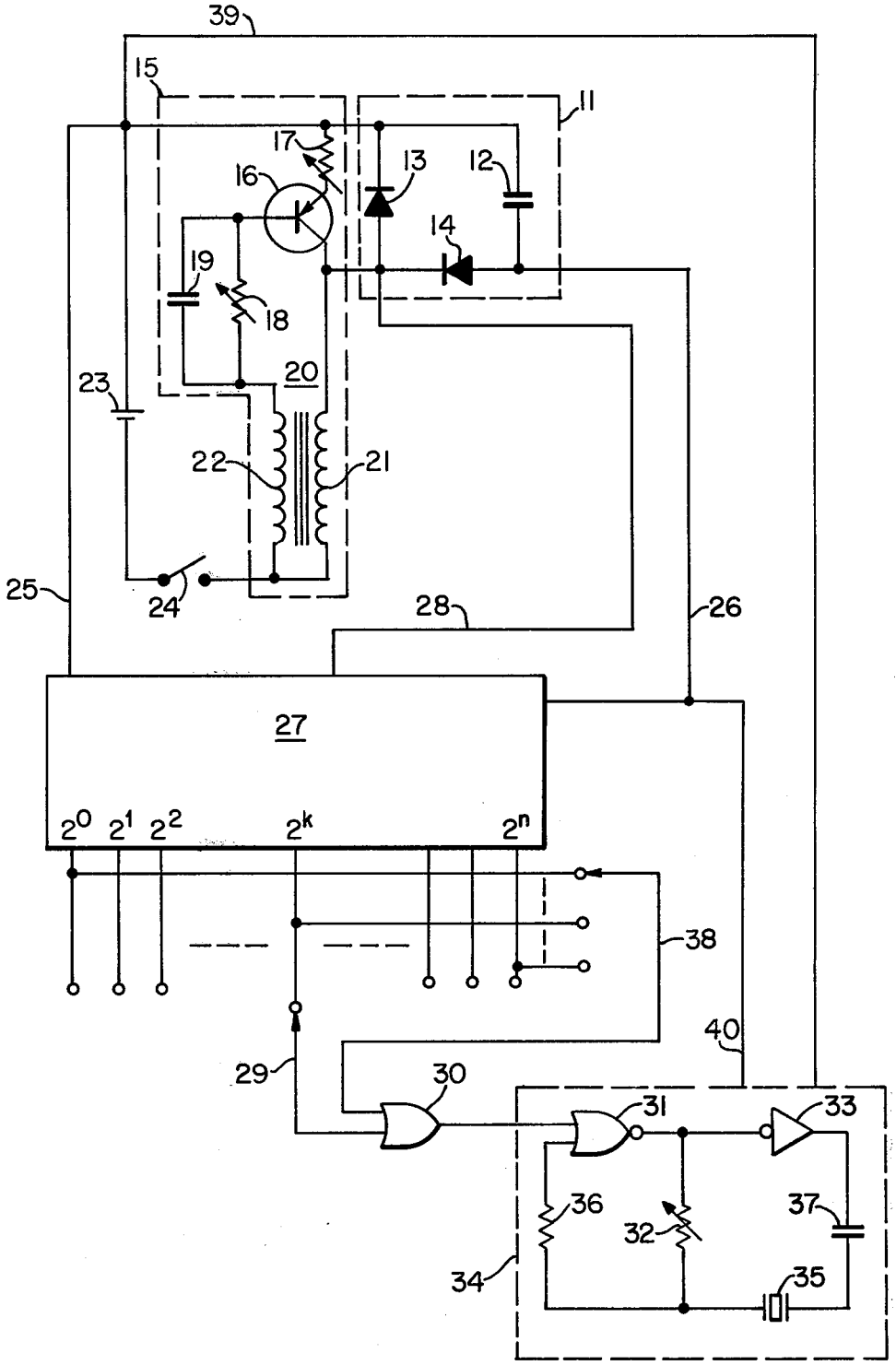
39
15
11
17
16
13
12
14
19
18
20
23
22
21
25
24
28
26
27
$2^0$ $2^1$ $2^2$ $2^k$ $2^n$
38
40
29
30
31
33
36
32
37
34
35

ALARM CIRCUIT

BACKGROUND OF THE INVENTION

This invention relates to an electronic circuit for producing an audible characteristically unique signal.

More specifically, this invention relates to circuitry which can be driven by a low DC voltage source and designed to activate an alarm when an associated contact is closed. The circuitry may be utilized in a horological device such as a clock or wrist watch as well as many other applications in which a unique tone would be desirable in an alert situation, e.g., doorbell, telephone, etc.

Electromagnetic transducers which include automatic vibrating elements are well known in the art and are commonly activated by a low DC voltage source, such as of 1.5 volts, at the closure of a contact switch. Further, alarm/alert devices of the electrodynamic or ceramic transducer (piezoelectric) type are well known and many are powered by low power circuits utilizing digital integrated circuit technology such as by building the active components using CMOS (complementary metal oxide semi-conductor) technology.

In driving a transducer such as a piezoelectric disk, it is known that increasing the voltage across the transducer increases the forces and strains on the transducer and the performance of the transducer is accordingly improved.

In the past, the frequency or wave form of the signal driving the vibrating transducer was not flexible enough to take into account artistic considerations involving the harmony of the emitted tone from the transducer. Further, the activation of the transducer element typically required transistor switching circuitry and separate discrete components to form an oscillating network.

The foregoing problems have been substantially eliminated by providing in a preferred embodiment of this invention a circuit which efficiently drives a transducer with a voltage much higher than that of the power supply and utilizes in a unique manner the intrinsic capacitance of the associated transducer. Flexibility is provided by the utilization of a multiple stage binary divider to generate many waves of fractional frequency to be modulated in any manner desired by the designer to achieve a multiplicity of tones and harmonies when the alarm/alert transducer is activated, all in a compact reliable manner.

SUMMARY OF THE INVENTION

It is an object of this invention to provide an alarm-/alert audible signal to be used in a device such as a clock or watch which produces a signal having a characteristic tone. It is a further object of this invention to provide alarm/alert circuitry which is straight-forward and provides for zero power consumption unless activated.

It is a still further object of this invention to provide circuitry for emitting a distinctive tone which can be driven by a single low DC voltage source.

It is still a further object of this invention to provide an electronic circuit for activating a piezoelectric acoustic transducer which utilizes the intrinsic capacitance of the piezoelectric transducer as the capacitive component of its own driving oscillator. Briefly stated, and according to one aspect of this invention, the foregoing objects are achieved by providing in a preferred embodiment an electronic circuit which is powered by a low voltage source and has a low power drain. The circuit, more specifically, may include a self starting voltage multiplier which increases the voltage to a sufficient level for standard circuit supply and for improved performance of an associated transducer.

The circuit also generates an input frequency signal, for modulating the acoustic tone. This input frequency drives a binary divider having a plurality of outputs. At least two of the outputs of the binary divider are combined to produce a signal for modulating a gated oscillator circuit including a piezoelectric transducer element. The intrinsic capacitance of the piezoelectric transducer contributes directly to the RC time constant of the gated oscillator driving it.

BRIEF DESCRIPTION OF THE DRAWING

The invention both as to its organization and principle of operation, together with further objects and advantages thereof, may better be understood by reference to the following detailed description of an embodiment of the invention when taken in conjunction with the accompanying drawing. The drawing is a circuit diagram illustrating an exemplary embodiment of the basic concepts of an acoustic alarm/alert circuit comprising a self starting voltage multiplier including a blocking oscillator, a binary counter, a logic circuitry, and a transducer element.

DESCRIPTION OF THE PREFERRED EMBODIMENT

Referring now to the drawing, a self starting voltage multiplier 11, 15 is enclosed in dotted lines and includes an electrolytic tantalum capacitor 12 having a value of 10 microfarads at 16 volts. The capacitor 12 is electrically connected in parallel to the series combination of first diode 13, used for breakdown protection of an associated transistor, and second diode 14. Both diodes 13 and 14 are of type 1N 914.

Blocking oscillator 15 is enclosed in dotted lines and includes a PNP transistor 16 having an emitter resistor 17 and a base resistor 18. A capacitor 19 is electrically connected in parallel to base resistor 18. Completing the blocking oscillator 15 is a high frequency ferrite transformer 20 having a primary winding 21 and a feedback winding 22. The primary winding 21 is connected at its first end to the junction of the collector of transistor 16 and to self-starting voltage multiplier 11, 15 between the junction of diodes 13 and 14. The other end of primary winding 21 is in common with a first end of feedback winding 22. The other end of feedback winding 22 is electrically connected to a junction between a first side of capacitor 19 and resistor 18. The other side of capacitor 19 and resistor 18 is connected to the base of transistor 16.

Transistor 16 is a PNP transistor designated as type 2N 3702. However, other types of transistors such as NPN transistors may be used in a manner well known in the art. Variable feedback resistor 17, which may or may not be used, has a typical value between 180 and 200 ohms and provides more stability against manufactured variations in the associated transistor. The base resistor 18 may be adjustable and typically has a value of 50,000 ohms. Capacitor 19 is a 22 pico farads capacitor. The transformer 20 is constructed to have a turns ratio of substantially 7:1. For example, the primary winding 21 includes 147 turns and the feedback winding 22 includes 23 turns wound in the appropriate orientation. The inductance of primary winding is substantially 0.026 henry. All windings utilize a 0.1 millimeter diameter standard copper wire.

A DC source of 1.5 volts or battery 23 is electrically connected between the free end of feedback resistor 17 and a first contact of switch 24. The second contact of switch 24 is electrically connected to the common point of windings 21 and 22. The free end of feedback resistor 17 is also connected between the series connection of diode 13 and capacitor 12.

The capacitor 12 is electrically connected at a first side, through lead 25, and at its second side, through lead 26, to the power terminals of a 14 stage binary counter/divider 27. The divider 27 may be of the type available from RCA and described in RCA's COS/-MOS Integrated Circuit Handbook SSD-203C, 1975, on pages 109–113, the contents of which is incorporated herein by reference. Lead 25 is connected to the high voltage power pin 16 and lead 26 is connected to the zero voltage power pin 8, all as detailed in the specification of the divider 27.

Further, lead 28 is connected at its first end to the junction of the series connection of diodes 13 and 14 and at its second end to the divider 27, such as at input pin 10 as disclosed in the specification of divider 27. The divider 27 has a plurality of outputs each of which corresponds to a binary stage. As depicted, an electrical connection is made from output stage $2^0$ through lead 38 and from output stage $2^k$ at lead 29. The other end of lead 38 is connected to a first input terminal or OR gate 30 and the other end of lead 29 is connected to a second input terminal of OR gate 30.

The output of OR gate 30 is connected to a gated oscillator circuit 34 enclosed in dotted lines. More specifically, the output of OR gate 30 is connected to a first input terminal of NOR gate 31. The output of NOR gate 31 is connected to a first end of a 20,000 ohms resistor 32, which may be adjustable, and to an input of an inverter 33. The output of the inverter 33 is connected to a first side of a 22 nano farad capacitor 37. The second side of capacitor 37 is connected to a first end of a ceramic transducer element such as piezoelectric transducer 35. The second end of transducer 35 is electrically connected to the second end of resistor 32 as well as to a second input terminal of NOR gate 31 through a 500,000 ohms resistor 36.

The gated oscillator 34 is similar to types described in the previously mentioned RCA-COS/MOS Data Book SSD-203c, 1975, pages 518–538, the contents of which are incorporated herein by reference. Further, logic elements which are equivalent to OR gate 30, NOR gate 31, and inverter 33 may be available on a single chip number 4001 such as described at page 32 of the previously mentioned RCA catalog incorporated herein by reference. The piezoelectric transducer 35 is of the flat thin disk type manufactured by National Manufacturing of Japan, and is available as part No. EFB-546CO2. The transducer 35 has a dimension of 27 millimeters for the ceramic plate and 20.2 millimeters for the diameter for the piezoelectric ceramic. The resonant resistance is 200 ohms and the resonant frequency is 4.6 K hertz with an electrostatic capacitance of 19,500 pico farads.

In operation, circuits 11 and 15 form a self-starting voltage multiplier constructed to include a blocking oscillator. Before any of the circuitry is activated, switch 24 must be in its closed position to connect the battery across the oscillator circuit 15. The switching of switch 24 to its closed or "on" position, may be accomplished manually or automatically in a response such as to a predetermined alarm/alert setting of an associted watch or clock mechanism. When the switch 24 is in its open position, zero power consumption is realized and the transducer 35 will become deactivated. The zero power consumption of standby is of importance especially in small battery powered equipment such as those utilized in wrist watches and clocks.

When the switch 24 is in its closed position, the voltage of the battery 23 is applied across the blocking oscillation 15. This biases the transistor 16 into a conductive state and a current path is established through the emitter and collector of transistor 16 through primary winding 21. The current in primary winding 21 increases until the transistor 16 saturates. Once transistor 16 saturation is reached, then the associated feedback winding 22 which is phased so that the electromagnetic field of the transformer 20 induces a voltage across winding 22, which turns the transistor 16, to an off or non-conducting state. Capacitor 19 improves the efficiency of the switching of transistor 16 to its off state, while feedback resistor 17 increases the stabilization of the oscillator 15.

When the transistor 16 is in its off state, the energy in winding 21 is released and the inductive voltage rise is caught by diode 14 for charging the capacitor 12. The capacitor 12 is charged to a voltage substantially higher than that of the battery 23. Voltages of 8 to 10 times that of the battery 23 are obtainable. This voltage is applied to the divider 27 through leads 25 and 26 and to gate 30 and gated oscillator 34 via leads 39 and 40. Since standard CMOS circuits typically have a voltage range of approximately 3 to 15 volts, using capacitor 12 as a source is more than adequate.

Further, lead 28 will deliver to the input pin of the divider 27 a square wave signal depending upon the characteristics of the circuit components in the oscillator 15. For example, a preferred embodiment has been chosen in which the transformer 20 is tuned as known in the art, to provide a frequency of 9.5 K hertz plus or minus 5% at the input pin of divider 27 through lead 28.

Thus, the electrolytic capacitor 12 provides dual function of working as a power supply for the following digital circuit as well as a power supply to the transducer. Further, the input frequency derived from the capacitor 12 at lead 28 is used to generate an input frequency for modulation of the ultimate acoustic tone. This input frequency is introduced to a binary dividing chain such as that of counter 27 in which 14 stages are utilized. Depending upon the combination of outputs to be combined at the output of binary counter 27, many different signals can be obtained.

More specifically, a large set of modulating signals may be obtained by combining at least two of the binary outputs of counter 27 to produce a complex frequency wave to be applied to the gated oscillator 34. It has been found to be particularly advantageous as well as aesthetically pleasing to electrically connect the $2^9$ and $2^{13}$ outputs of binary counter 27 to lead 28 and lead 29 respectively. Such a combination of outputs in this invention will provide a distinctive aesthetically pleasing output simulating the sound of a cricket when applied to the logic circuitry of gated oscillator 34. Another aesthetically pleasing sound may be generated by electrically connecting the $2^{14}$ and $2^{12}$ outputs of binary counter 27 to lead 28 and lead 29 respectively.

The repetition rate of the complex wave form and frequency components of that wave form of the square wave output signal of the binary counter 27 are easily deduced from well known binary calculation rules. The frequency of modulation and frequency of the vibrating transducer also converges to modify the harmony of the emitted tone. Further, an amplitude modulation of the complex wave form applied to the gated oscillator 34 is created by the current drain occuring when the transducer is activated to simulate tone stroke. This is a further factor in determining the characteristic sounds of the transducer utilizing the invention of the circuitry.

OR gate 30 combines at least 2 fractional frequency square wave forms from the output of binary counter 27 and the output of the OR gate 30 is used to gate an independent oscillator tuned at a frequency adapted to mechanical and acoustical characteristics of the electro acoustic transducer 35. Operationally, OR gate 30 will have a high output if either input or both inputs are high. If both inputs are low, the output of OR gate 30 will be low.

With respect to NOR 31, if either input or both inputs are high, then the output of NOR 21 will be low. If both inputs to NOR gate 31 are low, the output will be high.

The output of OR gate 30 will be a complex wave form of the combining frequencies of the chosen inputs from the output of the binary counter 27. This wave form will be used to turn the gated oscillator 34 on and off in a manner well known in the art. However, it is of importance that the gated oscillator 34 of the instant invention does not require capacitor 37 to be included in its circuit since the intrinsic capacitance of transducer 35 may be utilized as the capacitive component of its own driving oscillator. This will eliminate the requirement of an additional component.

Resistor 36 provides input protection to NOR gate 31 and its value can be chosen high enough to double the voltage applied to the capacitor 37 by the piezoelectric transducer 35 in a manner well known in the art. In order to adapt the impedance and to broaden the choice of the value of resistor 32, capacitor 37 can be placed electrically in series with the intrinsic capacitance of transducer 35. The capacitance formed by the combination of capacitor 37 and intrinsic capacitance of transducer 35 contribute with resistors 36 and 32, in a known way, to set the frequency of the acoustic signal.

While an embodiment and application of this invention has been shown and described, it will be apparent to those skilled in the art that many more modifications are possible without departing from the inventive concepts herein described. For example, it is considered within the scope of this invention to utilize a voltage multiplier from a single winding core if, such as inside a watch module at a test point, a convenient frequency source is available. Also the gated oscillator 34 may be modified, as well known in the art, to be suitable for controlling the repetition rate of the emitted tone as well as the tone frequency. The invention, therefore, is not to be restricted except as necessary by the prior art and by the spirit of the appended claims.

What is claimed as new and desired to be secured by Letters Patent of the United States is:

1. An acoustical alarm circuit comprising:

circuit means including a DC source for providing a low source of voltage and a self-starting voltage multiplier circuit, including a capacitor, for providing a higher source of voltage and for generating an input frequency signal;

counter means electrically connected to said circuit means and powered by said higher source of voltage for receiving said input frequency signal from said circuit means and for providing a plurality of fractional frequency outputs;

logic circuitry electrically connected to at least two of the fractional frequency outputs of said counter means for generating a modulated complex signal; and gated oscillator means including a sound generating transducer electrically connected to said circuit means and powered by said higher source of voltage and electrically connected to said modulated complex signal for providing an audible output signal.

2. The circuit as in claim 1 wherein said transducer includes an intrinsic capacitance which contributes directly to the time constant of the gated oscillator means driving said transducer.

3. The circuit as in claim 1 wherein said transducer element is a piezoelectric transducer.

4. The circuit as in claim 1 wherein said counter means is a binary divider containing fourteen fractional frequency outputs.

5. An alarm circuit for an horological instrument comprising:

circuit means including a DC source for providing a low source of voltage and a self-starting voltage multiplier circuit, including a capacitor, for providing a higher source of voltage and for generating an input frequency signal of approximately 9.5 K hertz;

binary counter means having 14 outputs of fractional frequency electrically connected to said circuit means and powered by said higher source of voltage for receiving said input frequency signal from said circuit means;

logic circuitry electrically connected to the $2^9$ and $2^{13}$ outputs for generating a modulated complex signal; and gated oscillator means including a sound generating transducer electrically connected to said circuit means and powered by said higher source of voltage and electrically connected to said complex modulated signal for providing an audible output signal characteristic of a cricket.

* * * * *